US005758580A

United States Patent [19]

Murray

[11] Patent Number: 5,758,580

[45] Date of Patent: Jun. 2, 1998

[54] PRINTING UNIT USING VARIOUS INK TYPES

[75] Inventor: Robert Richard Murray, Madbury, N.H.

[73] Assignees: Heidelberger Druckmaschinen AG, Heidelberg, Germany; Heidelberg Harris, Inc., Dover, N.H.

[21] Appl. No.: 614,591

[22] Filed: Mar. 13, 1996

[51] Int. Cl.[6] ..... B41F 31/00

[52] U.S. Cl. ..... 101/491; 101/147; 101/487

[58] Field of Search ..... 101/147, 483, 101/487, 488, 424.1, 424.2, 367, 450.1, 216, 491, 484, 349, 350.1, 3

[56] References Cited

U.S. PATENT DOCUMENTS

| | | | |
|---|---|---|---|
| 2,319,853 | 5/1943 | Durham | 101/491 |
| 2,556,262 | 6/1951 | Faeber | 101/491 |
| 2,651,992 | 9/1953 | Säuberlich | 101/488 |
| 2,804,693 | 9/1957 | Brodie | 101/488 |
| 2,972,302 | 2/1961 | Bernardi | 101/488 |
| 2,972,303 | 2/1961 | DeMarchi et al. | 101/491 |
| 3,356,030 | 12/1967 | Greubel | 101/452 |
| 3,412,053 | 11/1968 | Pugliese | 101/491 |
| 3,877,372 | 4/1975 | Leeds | 101/465 |
| 3,951,892 | 4/1976 | Drury, Jr. et al. | 427/288 |
| 4,137,083 | 1/1979 | Hedrick | 101/491 |
| 4,173,554 | 11/1979 | Sulzberg | 260/DIG. 38 |
| 4,278,467 | 7/1981 | Fadner | 101/148 |
| 4,772,518 | 9/1988 | Marthe | 428/511 |
| 4,854,969 | 8/1989 | Bassemir et al. | 106/2 |
| 4,954,556 | 9/1990 | Bull et al. | 101/491 |
| 5,026,755 | 6/1991 | Kveglis et al. . | |
| 5,098,478 | 3/1992 | Krishnan et al. | 106/20 R |
| 5,189,960 | 3/1993 | Valentini et al. | 101/349 |
| 5,309,838 | 5/1994 | Kurz . | |
| 5,370,046 | 12/1994 | Spiegel et al. | 101/487 |
| 5,370,906 | 12/1994 | Dankert | 101/457 |
| 5,375,518 | 12/1994 | Kurz . | |
| 5,417,749 | 5/1995 | Krishnan et al. | 106/20 R |
| 5,452,657 | 9/1995 | Kurz . | |
| 5,611,278 | 3/1997 | Garner et al. | 101/349 |

FOREIGN PATENT DOCUMENTS

| | | | |
|---|---|---|---|
| 474605 | 6/1951 | Canada | 101/424.1 |
| 41 19 348 A1 | 6/1991 | Germany . | |
| 402099382A | 4/1990 | Japan | 101/491 |
| 0549235 | 11/1943 | United Kingdom | 101/488 |

OTHER PUBLICATIONS

Leach, R. H. et al., "Inks and Varnishes for Specific Purposes," *The Printing Ink Manual*, Fifth Edition, 1993 pp. 571–576.

*Primary Examiner*—Eugene H. Eickholt
*Attorney, Agent, or Firm*—Kenyon & Kenyon

[57] ABSTRACT

A printing unit (1) of a rotary printing press for using various ink types is provided. The printing unit includes an inking mechanism (45), a print cylinder (3), and a blanket cylinder (2). The inking mechanism (45) and the cylinders (2, 3) are mounted in side walls of the printing unit (1). A housing (14) at least partially surrounds the inking mechanism (45) and the cylinders (2, 3) to maintain a surrounding atmosphere within an at least semi-enclosed area (100) of the printing unit (1). A chemical agent is selectively added to the atmosphere in the semi-enclosed area (100) to reduce the rate of evaporation of a substance in the ink.

41 Claims, 9 Drawing Sheets

PRINTING UNIT USING VARIOUS INK TYPES

FIELD OF THE INVENTION

The present invention concerns a printing unit for a rotary printing press which can utilize various ink types.

BACKGROUND OF THE INVENTION

U.S. Pat. Nos. 5,309,838, and 5,375,518 each purport to disclose a system for keeping the printing plates of a printing press at a moderate temperature. A cooling air blower girder extends longitudinally over the printing plate surface and blows cold air onto the printing plate's surfaces in order to keep its temperature of a desired value. The blast air girder contains at least one heat exchanger and at least one blower as well as at least one air return duct, which together forms a cooling air cycle, through which the air blown onto the printing plate surface is returned to the air inlet of the heat exchanger and optionally mixed with fresh air blown by the blower once again through the heat exchanger onto the printing plate surface. The blast air girder purportedly presents an energy saving compact structural unit for keeping the printing plate surface at a moderate temperature.

U.S. Pat. No. 5,452,657 purportedly relates to a temperature control system for printing press cylinders. It contains at least one compressed air line having at least one blast air opening for blowing cold air against a cylinder which is to be cooled. At least one recirculation circuit which is separate from the cold air of the compressed air line and by which air which has been blown by the blast air opening onto the cylinder is drawn off by means of a blower contained in the circulation circuit and is blown parallel to the cold air again onto the cylinder. In this way, the temperature of the cold air can be active, without prior change of temperature on the cylinder. The cold air deflected by the cylinder is returned to the cylinder for additional cooling.

U.S. Pat. No. 5,098,478 relates to water based ink compositions. The water based ink composition comprises water, a pigment, a non-ionic surfactant having a solubility in water of less than about 0.5 wt % and a solubilizing agent sufficient to solubilize substantially all of the non-ionic surfactant.

U.S. Pat. No. 5,026,755 purports to disclose a water based printing ink prepared from polyamid/acrylic graft copolymers. It is prepared by reacting the polyamid with the acrylic monomer or monomers in an alcohol solution in the presence of a free radical peroxidic initiator. The graft copolymer purports to be particularly useful as the resin component of a water based printing ink.

Finally, German laid open patent application DE 41 19 348 A1 purports to disclose a method for offset printing and a printing unit for waterless offset printing. A conventional offset plate is used with a water based printing ink, containing a pigment, water, 5–50% water soluble macromolecular binding agents, a hygroscopic organic fluid, preferably a multivalent alcohol.

SUMMARY OF THE INVENTION

The use of prior art air blasting control devices, however, is ineffective in preventing premature dry-up of ink in printing presses and, in fact, may contribute to premature dry-up. This is particularly problematic on those components within the printing unit which are difficult to clean or to gain access to. Moreover, in order to clean the dried ink off of these components, the press must be shutdown. Since a shutdown of the press in order to clean off dried ink residue reduces the productivity of the press, there is a need to reduce the formation of dried ink buildup.

The present invention reduces the formation of dried ink build-up by taking advantage of the fact that ink dry-up is caused by the evaporation of a volatile substance, e.g. VOC (volatile organic components), ammonia, ethanol amine or other amine compounds, and/or water, from the ink. In accordance with the present invention, a printing unit is provided which prevents or reduces the evaporation of the substance from the ink, thereby preventing premature ink dry up. The printing unit according to the present invention includes an inking mechanism, a plate cylinder, and a blanket cylinder supported within a frame. During operation of the printing unit, ink is applied as an ink film through the inking mechanism and onto a print form mounted on the print cylinder. A housing is mounted within the frame which at least partially surrounds the inking mechanism and print cylinder. In this manner, a semi-enclosed space surrounds the print cylinder and inking mechanism. Alternatively, the housing may also partially surround the blanket cylinder. The printing unit further includes a chemical supply for applying a chemical agent, e.g., water, VOC, ammonia, ethanol amine (or any other organic amine), in gaseous form into an atmosphere within the semi-enclosed space. By selectively introducing the chemical agent into the atmosphere, evaporation of the substance from the ink film on the inking mechanism and print form is reduced and controlled.

In accordance with a first embodiment of the present invention, the printing unit further includes a cooling mechanism and a humidifier for controlling the atmospheric conditions within the semi-enclosed space. The cooling mechanism and humidifier improve printing conditions in a number of ways. First, the ability of the atmosphere within the semi-enclosed space to absorb the substance from the ink film is a function not only of the amount of the chemical agent in the atmosphere, but also of the temperature and humidity in the atmosphere. In addition, temperature and relative humidity affect print quality independent of ink-dry up problems. For example, if the temperature of the ink (or the surface the ink is being applied to) is too low, ink transfer will be impeded. However, if the temperature is too high, then the ink will adhere to the non-imaged area of the plate as well as the imaged area of the printing plate. This phenomena is known as "toning" of the image. Similarly, if the humidity is too high, condensation will occur, resulting once again in toning.

A control unit controls the cooling mechanism, the humidifier, and the chemical supply to provide a suitable temperature, relative humidity, and chemical agent content in the atmosphere for high quality printing without ink dry up. The control unit monitors the temperature, humidity, and chemical agent content of the atmosphere within the semi-enclosed space via respective temperature, humidity, and chemical agent sensors, and then selectively activates the cooling mechanism, the humidifier, and the chemical supply as a function of the sensor readings.

For example, if the printing unit is configured to print with a water based ink, then ink dry-up can be controlled by controlling the evaporation of ethanol amine (or, for example, another organic amine compound or ammonia) from the ink. The evaporation of ethanol amine from the ink, in turn, can be prevented by injecting a sufficient amount of ethanol amine into the atmosphere within the semi enclosed space to prevent the evaporation of the ethanol amine from the ink. As an illustration, at 85 percent relative humidity and 93 degrees Fahrenheit, a concentration of 300–20,000 parts per million of ethanol amine (or ammonia) in the atmosphere will provide acceptable printing conditions for a water based ink containing 2% ethanol amine (or ammonia).

In certain cases where the volume of the semi-enclosed space is small and relatively well sealed, and the printing unit components enclosed within the semi-enclosed space generate little heat, there will be no need for a cooling mechanism, humidifier or chemical supply. In such a case, the gases in the atmosphere will quickly come to equilibrium locally near the ink transferring parts to prevent ink dry-up.

In accordance with a second embodiment of the present invention, the walls of the housing are hollow, and the cooling mechanism includes a cooling inlet and a cooling outlet, each connected to the hollow interior of the walls of the housing. A cooling agent, e.g. cold water or air, is circulated through the hollow interior of housing, entering via the cooling inlet and exiting through the cooling outlet. The cooling agent lowers the temperature of the housing, which, in turn, lowers the temperature within the semi-enclosed space. In addition, the outer surface of the housing is insulated so that the air within the semi-enclosed space surrounded by the inner surface of the housing remains cold. A cooling valve, which is coupled either to the cooling inlet or the cooling outlet, is selectively actuated by the control unit as a function of one or more of the sensor outputs to control the cooling of the semi-enclosed space.

In accordance with a third embodiment of the present invention, the chemical supply includes a reservoir, a liquid solution containing the chemical agent (e.g., ethanol amine, another organic amine compound, or ammonia, in solution) and a heating element. In accordance with this embodiment, the control unit can increase the chemical agent content of the atmosphere by activating the heating element, thereby causing more of the chemical agent in the solution to evaporate. Preferably, the heating element is located relatively close to the reservoir.

In accordance with a fourth embodiment of the present invention, the chemical supply includes a gas intake connected to a supply mechanism for supplying the chemical agent in gaseous form. A valve is mounted between the gas intake and the supply mechanism, and controlled by the control unit.

The present invention can be used with a variety of ink types, including, for example, water based inks, oleoresinous inks (containing hydrocarbons in the 270° F. boiling range, e.g. Magee oils), acrylate inks cured by radiation, and high viscosity inks known as paste inks. Preferably, the present invention uses a water based paste ink which does not contain any volatile organic components (VOCs) so that the enclosed atmosphere is not subject to explosion. In accordance with the present invention, the chemical used as a pH increaser or drying prevention agent in the ink is prevented from evaporated by applying a chemical to the atmosphere in the semi-enclosed area within the housing. Preferably, the chemical applied to the atmosphere is the same chemical which serves as the pH increaser or drying prevention agent in the ink. For example, in a water based ink which uses ethanol amine as a pH increaser, ethanol amine can be added to the atmosphere in the semi-enclosed area to prevent ink dry-up. If the amount of ethanol amine in the atmosphere causes the partial pressure of the ethanol amine in the atmosphere to be equal to the vapor pressure of the ethanol amine in the ink, then the ethanol amine will not evaporate from the ink into the atmosphere.

If the chemical agent is the same chemical as the substance in the ink, the chemical agent can not only be used to prevent drying or precipitation of resin from the ink as described above, but also may serve as a pH increaser by increasing the amount of the substance in the ink. For example, if the substance in the ink is ethanol amine, an increase in the amount of ethanol amine in the ink will increase the pH of the ink, thereby reducing drying or precipitation of resins and solvents in the ink. If the amount of ethanol amine in the atmosphere causes the partial pressure of the ethanol amine in the atmosphere to be greater than the vapor pressure of the ethanol amine in the ink, then the ethanol amine will flow from the atmosphere into the ink, thereby increasing the amount of the ethanol amine in the ink, and the pH of the ink.

DETAILED DESCRIPTION OF THE INVENTION

Figure 1:
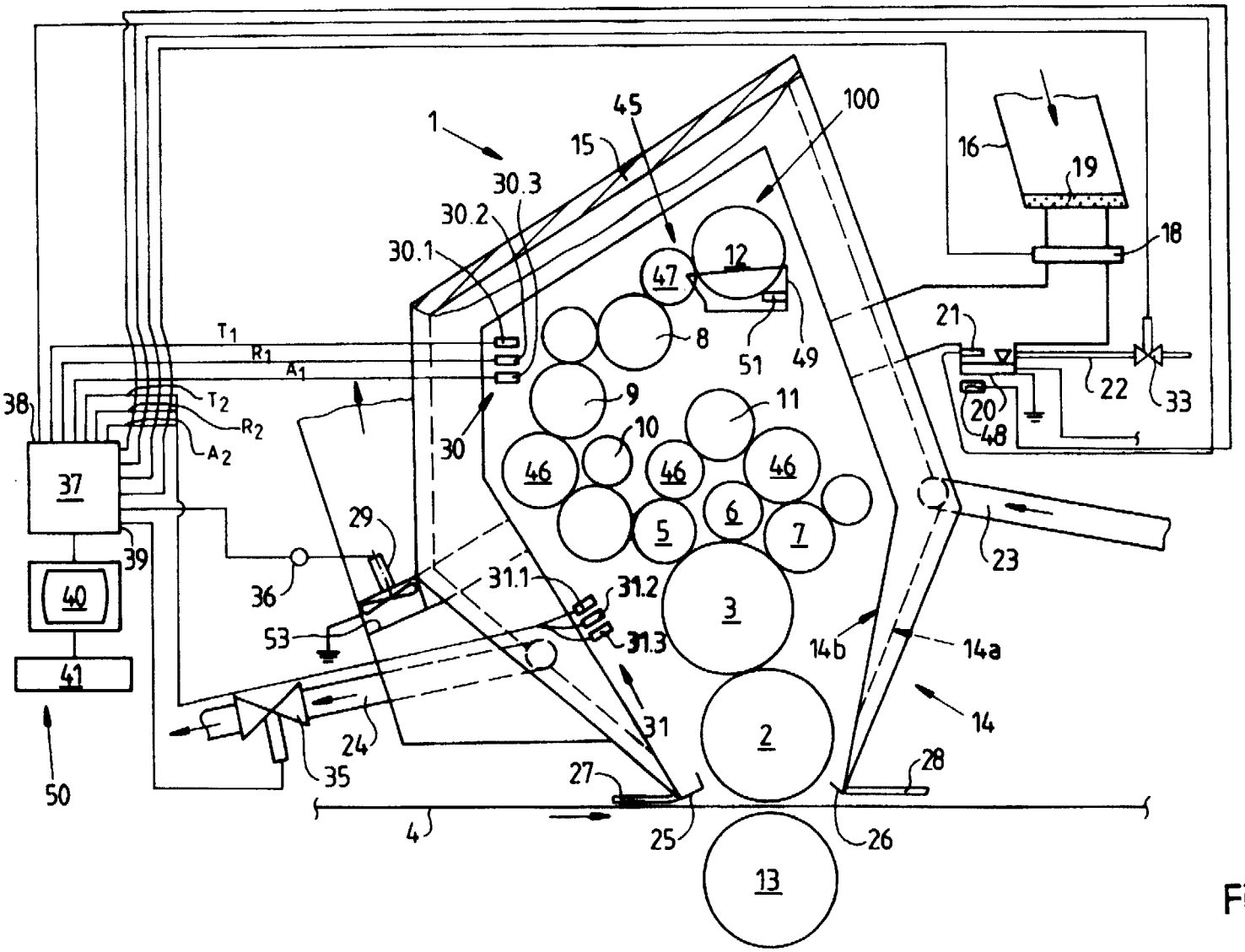
FIG. 1 shows a printing unit according to the present invention.

FIG. 1 shows a printing unit 1 according to the present invention for preventing premature dry-up of ink. The printing unit 1 of a rotary printing press includes an upper inking unit 45, an upper print cylinder 3 and an upper blanket cylinder 2, which cooperate to print ink onto an upper side of a web of material 4. A cylinder 13 is shown below the web 4. A print form suitable for printing with inks (for example, water based inks) is mounted on the print cylinder 3. If the printing unit 1 is configured as a non-perfecting press, the cylinder 13 is an impression cylinder. If the printing unit 1 is configured as a perfecting press, the cylinder 13 is a blanket cylinder and the printing unit 1 includes a corresponding lower inking unit and lower print cylinder (not shown).

The inking unit 45 includes an ink fountain roller 12 supplying the ink (e.g., water based ink) to rollers 5–11, 46–47 of the inking unit 45. By splitting the ink film on each surface of each of the respective rollers 8–11, 46, a thin film of ink is supplied to the surface of form rollers 5, 6, 7. A first form roller 5, a second form roller 6 and a third form roller 7 apply the thin film of ink onto the surface of the print form(s) which are mounted on the surface of the print cylinder 3. Along the path the film of ink takes through the respective roller surfaces of the inking unit of the printing unit 1, there is arranged a metering roller 47, a plurality of distribution rollers 8, 9, 11, and a plurality of vibrator rollers 46. Naturally, the number, type, and arrangement of rollers in the inking unit 45 can be different from the arrangement of FIG. 1.

The print form may be configured as a flat printing plate mounted on the surface of the print cylinder 3 by its leading and trailing edges, or as a sleeve shaped print form mounted axially over the print cylinder. Over the circumference of the blanket cylinder 2 there can either be arranged a conventional flat rubber blanket or a sleeve-shaped printing blanket. The blankets and print forms can be installed and removed in any conventional manner.

The inking unit 45 of the printing unit 1 and the printing unit cylinders 2, 3 are encapsulated within a housing 14. The inking unit 45 (including rollers 5–12, 46–47), the cylinders 2, 3, and the housing 14 are supported by sidewalls (not shown). The housing 14 forms a semi-enclosed area 100 around the ink unit 45 and the cylinders 2, 3. Preferably, the housing forms a semi-enclosed area around the inking unit 45, and print and blanket cylinders as shown. However, it is also possible to configure the housing to form a semi-enclosed area only around the inking mechanism 45 and print cylinder 2; only around the inking mechanism 45; or only around the print cylinder 2. In a perfecting press, the housing 14 could also be constructed around the lower inking unit, plate and blanket cylinders.

The housing 14 is hollow and has an outer wall **14*a* and an inner wall 14*b*. An insulating material 15 surrounds the outer wall 14*a*. An air intake 16 extends from the outside the housing 14 through the inner wall 14*b*. In order to provide fresh air to the semi-enclosed area 100 of the housing 14 and to the rollers 5–11, 46–47 and cylinders 2, 3, air passes through an air filter 19 mounted within the air intake 16 and into the semi-enclosed area 100. A humidifier 18 is mounted below the air filter 19 for controlling the humidity within the semi-enclosed area. The humidifier 18 is coupled to, and controlled by, a control unit 37. An air exhaust 53 also extends from outside the housing 14 through the inner wall 14*b*. The air exhaust 53 includes an air blower 29 for exhausting air from the semi-enclosed area 100. The air blower 29 is also connected to, and controlled by, the control unit 37**.

The air intake 16 further includes a reservoir 20 which is connected to a supply hose 22 and grounded. The supply hose 22 includes a supply valve 33. Alternatively, the reservoir 20 could be located within the semi-enclosed area 100, or connected to the semi-enclosed area via a separate intake. The reservoir 20 contains an amount of a chemical agent, e.g.. ethanol amine, another organic amine compound, or ammonia, in a dilute solution. A sensor 21 is mounted within the reservoir for monitoring the level of the reservoir 20. Preferably, the level of the reservoir is periodically checked by the sensor 21 to provide a precise reading of the solution level.

A cooling inlet 23 and cooling outlet 24 each extend from outside the housing 14 through the outer wall **14*a*. A cooling agent, e.g. cold water or cold air, enters the hollow interior of the housing via the cooling inlet 23 and exits via the cooling outlet 24 to allow for temperature control over the housing 14 and consequently over the atmosphere which surrounds the rollers 4–11, 46–47 and cylinders 2, 3. The flow of the cooling agent through the inlet 23 and outlet 24 can be adjusted by controlling valve 35 which can be mounted at the outlet 24, at the inlet 35, or at both the outlet and inlet. Preferably, the valve 35 is mounted at the outlet 24 as shown. The valve 35 is connected to, and controlled by, the control unit 37 for controlling the flow of the cooling agent through the hollow interior of the housing 14**.

A first sensor set 30, including first sensors 30.1, 30.2, and 30.3, and a second sensor set 31, including second sensors 31.1, 31.2, 31.3, are arranged within the semi-enclosed area 100 of the housing 14. The first sensor set 30 is arranged adjacent to the inking unit 45 to monitor the atmosphere surrounding the inking unit 45. The second sensor set 31 is arranged adjacent to the cylinders 2, 3 to monitor the atmosphere surrounding the cylinders 2, 3. The first and second sensor sets 30, 31 are connected to the control unit 37. Each sensor set 30, 31 includes a respective temperature sensor 30.1, 31.1, a relative humidity sensor 30.2, 31.2, and a chemical agent (e.g., ethanol amine, other organic amine, or ammonia) sensor 30.3 and 31.3. It is understood that additional sensor sets can be mounted in key locations as necessary. Each of the sensors 30.1, 30.2, 30.3, 31.1, 31.2, 31.3 have respective output(s) which are individually connected to the control unit 37.

A central control system 50 includes the control unit 37. The control unit 37 includes an input 38 for receiving input from the sensors 30, 31 and an output 39 for controlling the air blower 29, the humidifier 18, the supply valve 33, and the cooling outlet valve 35. A display 40 and keyboard 41 are connected to the control unit 37 to allow a press operator to monitor the status of the sensors and to control the state of the valves and the air blower.

In order to provide optimum printing conditions, and to prevent premature ink dry-up, the control unit maintains the temperature, relative humidity, and chemical agent content of the atmosphere within the semi-enclosed area within desired ranges. The precise temperature and humidity levels, and the type and amount of chemical agent may vary depending on the type of ink and the location within the housing. The present invention can be used with a variety of ink types, including, for example, water based inks, oleo-resinous inks (containing hydrocarbons in the 240°–320° F. boiling range, e.g., Magee oils), acrylate inks cured by radiation, and high viscosity inks known as paste inks. Preferably, the present invention uses a water based ink, which does not contain any volatile organic components (VOCs). In general, the temperature should be kept within a temperature range which is high enough to promote good ink transfer, and low enough to prevent toning. The relative humidity, in turn, should be low enough to prevent condensation, but high enough to minimize evaporation of water from the ink. In order to prevent premature ink dry-up, the amount of chemical agent in the atmosphere should be sufficient to reduce the evaporation of the chemical substance acting as a pH increaser or drying prevention agent in the ink. The amount of chemical agent needed, in turn, is a function of the nature of the chemical agent, the nature of the chemical substance in the ink, the relative humidity, and the temperature of the atmosphere within the semi-enclosed area 100 adjacent to the ink transferring surfaces. The desired levels for the temperature, humidity, and chemical agent can be empirically determined through testing various temperature, humidity, and chemical agent levels with the desired ink.

In accordance with the illustrative embodiment of the present invention shown in FIG. 1, a press operator inputs a desired temperature level, relative humidity level, and chemical agent level for the printing unit 1 to the control unit 37 via the keyboard 41. The control unit 37 monitors the outputs of the temperature sensors 30.1, 31.1, the relative humidity sensors 30.2, 31.2, and the chemical agent sensors 30.3, 31.3. If the control unit determines that the temperature is above the desired level, it will open the cooling outlet valve 35 and circulate the cooling agent through the hollow interior of the housing 14, thereby cooling the atmosphere within the semi-enclosed area 100, e.g., by conduction, convection, and radiation. Once the temperature drops below the desired temperature level, the valve 35 will be closed. As a result, the temperature in the semi-enclosed area 100 will continually oscillate about the desired temperature level. Similarly, if the control unit determines that the humidity is below the desired level, it will activate the humidifier thereby adding moisture to the air traveling through the air intake 16 into the semi-enclosed area 100, and increasing the humidity of the atmosphere within the semi-enclosed area 100. Once the humidity rises above the desired humidity level, the humidifier will be turned off. As a result, the humidity in the semi-enclosed area 100 will continually oscillate about the desired humidity level. Finally, if the control unit determines that the chemical agent level is below the desired level, it will activate a heater 48 thereby causing the chemical agent in the reservoir to evaporate from the solution more quickly into the air passing through the air intake 16 to the semi-enclosed area and increasing the chemical agent content of the atmosphere within the semi-enclosed area 100. Once the chemical agent level rises above the desired level, the heater 48 is turned off. As a result the chemical agent content in the semi-enclosed area will continually oscillate about the desired level.

The present invention will now be described in more detail with regard to water based inks. The print form is suitable for receiving and transferring an image using water based inks. It has been found that "waterless" type printing plates, such as those manufactured by Toray Industries, or those described in U.S. Pat. No. 5,370,906 to Danker are also suitable for printing with water based inks. As an example, a Toray Industries printing plate having an aluminum oxide substrate with an image area coated with a photopolymer whose surface is hydrophilic in nature and a non-image area coated with a silicone polymer may be used.

An illustrative water-based ink for use with the present invention may include the components set forth below. The water phase of the ink is supplied by the water present in the acrylic resin latex, hydroxypropyl cellulose, hydroxyethyl ethylene urea, and the maleated rosin ester. The pH increaser in the ink is supplied by the ethanol amine:

| Component | Amount, wt. % |
|---|---|
| Styrene/maleic anhydride resin | 12 |
| Phthalocyanine Blue pigment | 12 |
| Acrylic resin latex (50% wt. % solids) | 5 |
| Hydroxypropylcellulose (3% wt. % solids) | 10 |
| Hydroxyethylethylene urea (70% wt % solids) | 8 |
| Monoethanol amine | 2 |
| Polyethylene Wax | 2 |
| Ethoxylated acetylenic diol surfactant | 2 |
| Maleated rosin ester (50 wt. % solids) | 47 |
| Total | 100 |

In order to provide optimum conditions for the printing with water based inks, and to prevent the ink from drying prematurely in the inking unit or cylinders, the relative humidity, temperature, and ethanol amine level within the semi-enclosed area 100 in the housing 14 are maintained at certain predetermined levels. For example, in a water based ink containing 2% ethanol amine, it has been found that by providing an atmosphere containing 300 to 20,000 parts per million of ethanol amine at a temperature of 93°–95° F. and a relative humidity between 75% and 95%, high print quality can be maintained. Naturally, these levels are merely illustrative, and may vary in accordance with a number of factors including the particular construction of the printing unit, the particular composition of the water based ink, print form and paper being used. The temperature, relative humidity, and ethanol amine levels are monitored by the control unit, and the atmosphere within the semi-enclosed area 100 is maintained within the desired temperature, relative humidity, and ethanol amine level ranges by selectively activating the cooling outlet valve 35, the heater 48, and the humidifier 18 as described above.

When a printing press is first started, the printing unit components 2, 3, 5–12, 14–15, 46–47 will be relatively cold. Therefore, the control unit 37, by monitoring the temperature sensors 30.1, 31.1, will determine that the temperature within the semi-enclosed area 100 is below the desired temperature level for the water based ink, print form, and paper being used. The control unit 37 will then display a message on the display 40 advising the press operator to pre-heat the printing unit 1 prior to printing. Such a pre-heating could be accomplished by running the press while off impression until the temperature within the semi-enclosed area 100 has reached the desired level. Alternatively, a heating element (not shown) could be arranged within the semi-enclosed area to pre-heat the atmosphere, and controlled via the control unit 37.

In contrast, after the printing press has been printing for a period of time, the temperature within the printing unit 1 may rise above the desired temperature level. The control unit 37, by monitoring the temperature sensors 30.1, 31.1, will determine that the temperature within the housing 14 is above the desired temperature level for the water based ink, print form, and paper being used, and will then lower the temperature within the semi-enclosed are by opening the cooling outlet valve 35 as described above.

The rise in temperature caused by operation of the press may also affect the relative humidity within semi-enclosed area 100 of the housing 14. For example, an increase in temperature results in a decrease in relative humidity, thereby causing the atmosphere surrounding the surface of the rollers carrying the ink film to become too dry. This, in turn, causes evaporation of ethanol amine and water from the ink. The control unit 37, by monitoring the humidity sensors 30.2, 31.2, or additional sensors placed in critical areas, will determine that the humidity within the housing 14 is below the desired level for the water based ink being used. Upon determining that the humidity is below the desired level, the control unit will increase the humidity by controlling the humidifier 18 as described above.

As discussed above, the percentage of ethanol amine in the air within the semi-enclosed area 100 of the housing 14 will also affect ink dry-up. The control unit 37, by monitoring the sensors 30.3, 31.3, will determine that the ethanol amine level within the housing 14 is below the desired level for the water based ink being used. The control unit 37 can then increase the ethanol amine level in the atmosphere by activating the heater 48. If the ethanol amine level rises above acceptable levels, the amount of ethanol amine in the semi-enclosed area within the housing 14 can be decreased by activating the air blower 29 to remove the excess ethanol amine from the semi-enclosed area.

FIGS. 2*a–e* show illustrative flow charts for the control unit 37 of FIG. 1. The control unit 37 monitors the output of the sensors and compares them to various set point values and alarm values as set forth below. Based upon these comparisons, the control unit 37 controls the valves 33, 35, the humidifier 18, the air blower 29, and the heater 48. The above referenced flow charts, however, are merely illustrative, and could be replaced with any suitable algorithm known in the art for matching a measured value to a desired value. For example, while the flow charts of FIGS. 2*a–e* may result in measured values which oscillate about the desired value, it is contemplated that other known closed loop control algorithms can be used which would reduce or eliminate these oscillations. It is further understood that additional sensors and control devices can be added to control the temperature, humidity, and chemical agent concentration more locally to provide for control over local variation in the humidity, temperature, chemical substance levels. For example, since the gear side of a printing press generally gets hotter than the work side of the printing press, it may be desirable to separately monitor the gear and work sides of the press, and to control them accordingly.

Referring to FIG. 2(*a, e*), the control unit 37 maintains a set point$_R$ and alarm$_R$ level which establish a minimum and maximum relative humidity value for the atmosphere within the semi-enclosed area 100; a set point$_T$ and alarm$_T$ level which establish a minimum and maximum temperature value for the atmosphere within the semi-enclosed area 100; and a set point$_A$ and alarm$_A$ level which establish a minimum and maximum ethanol amine level for the atmosphere within the semi-enclosed area 100. These alarm and set point levels are selected as a function of the particular ink being used. For example, for a water based ink containing 2% ethanol amine, the following set points and alarms have been found to be effective for controlling the atmosphere within the semi-enclosed area:

set point$_T$=93 degrees Fahrenheit alarm$_T$=98 degrees Fahrenheit set point$_R$=75% alarm$_R$=95% set point$_A$=300 parts per million alarm$_A$=20,000 parts per million

Moreover, additional alarm values may also be useful. For example, extremely low relative humidity, e.g., below 35%, may increase the likelihood of a web break due to the high tack of the ink at low humidity. Therefore, an additional relative humidity alarm could be triggered by the relative humidity dropping below 35%.

Figure 2A:
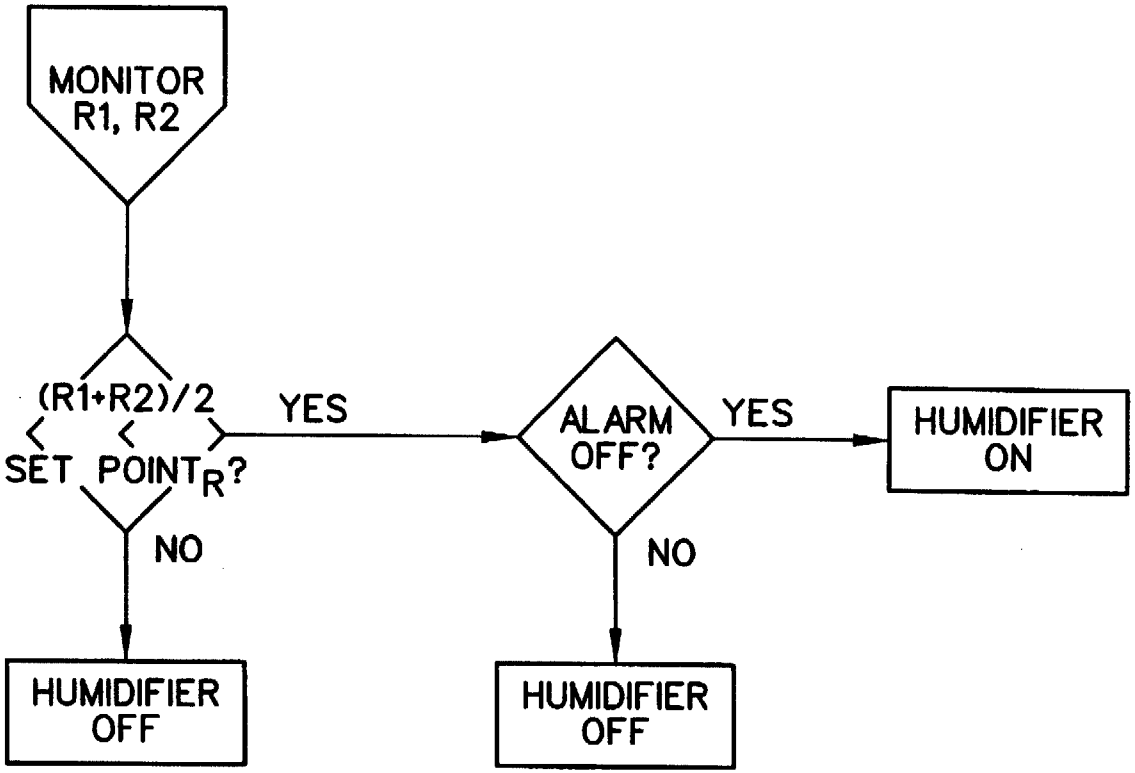
FIG. 2*a–e* show flow charts for a control unit of the printing press of FIG. 1.
Figure 2B:
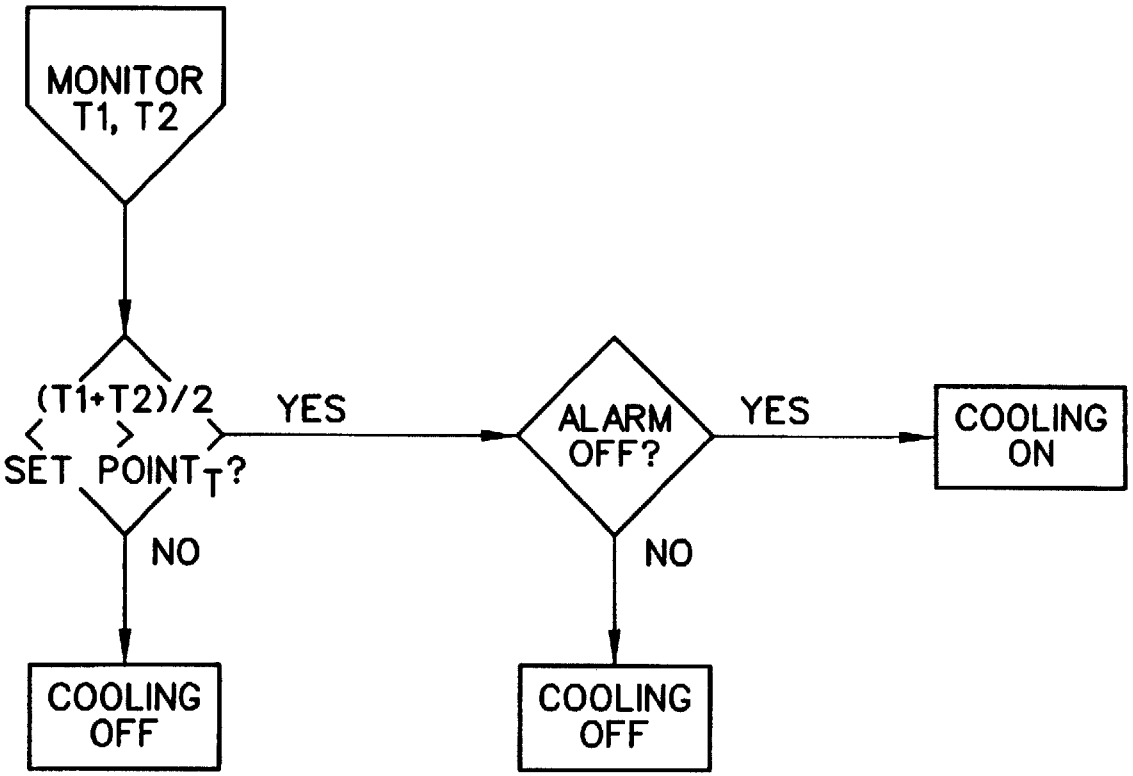
Figure 2C:
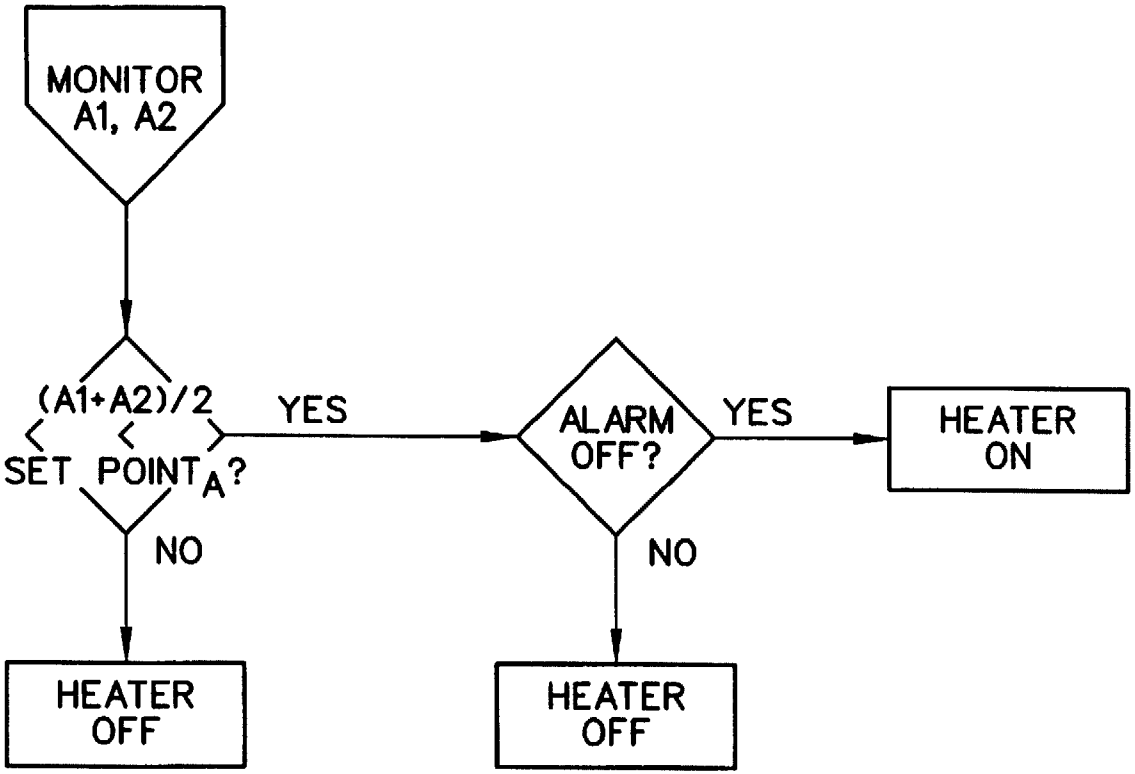
Figure 2D:
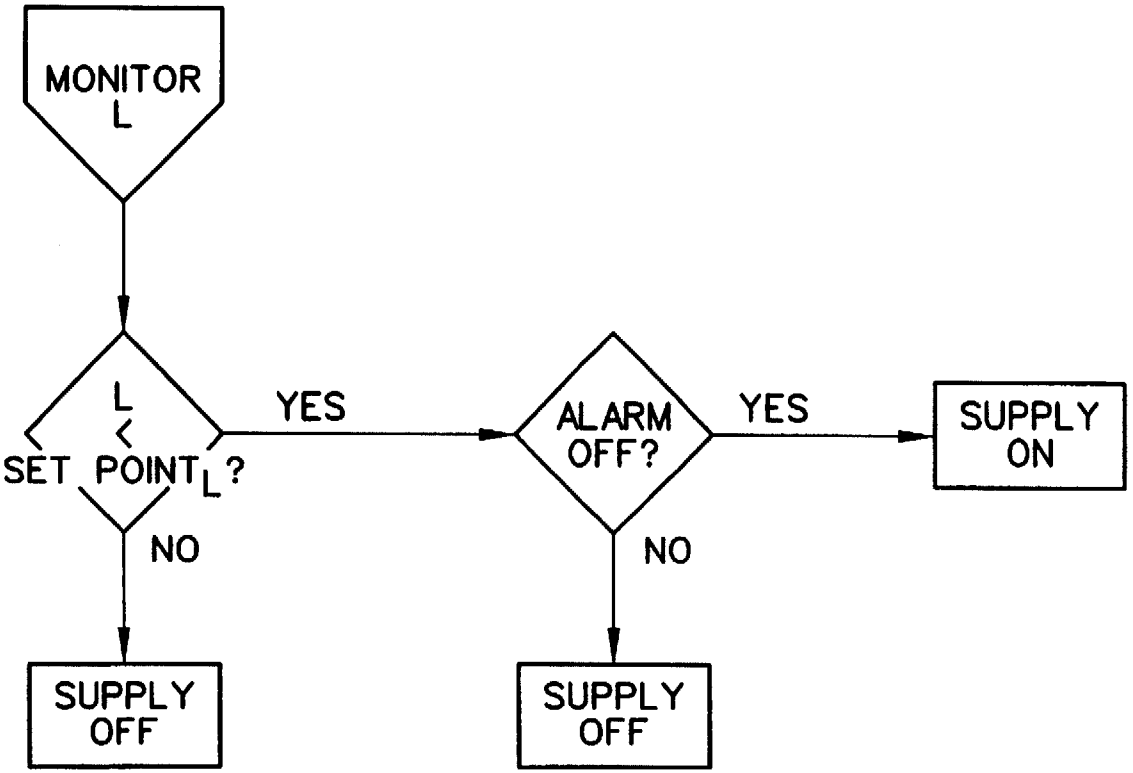
Figure 2E:
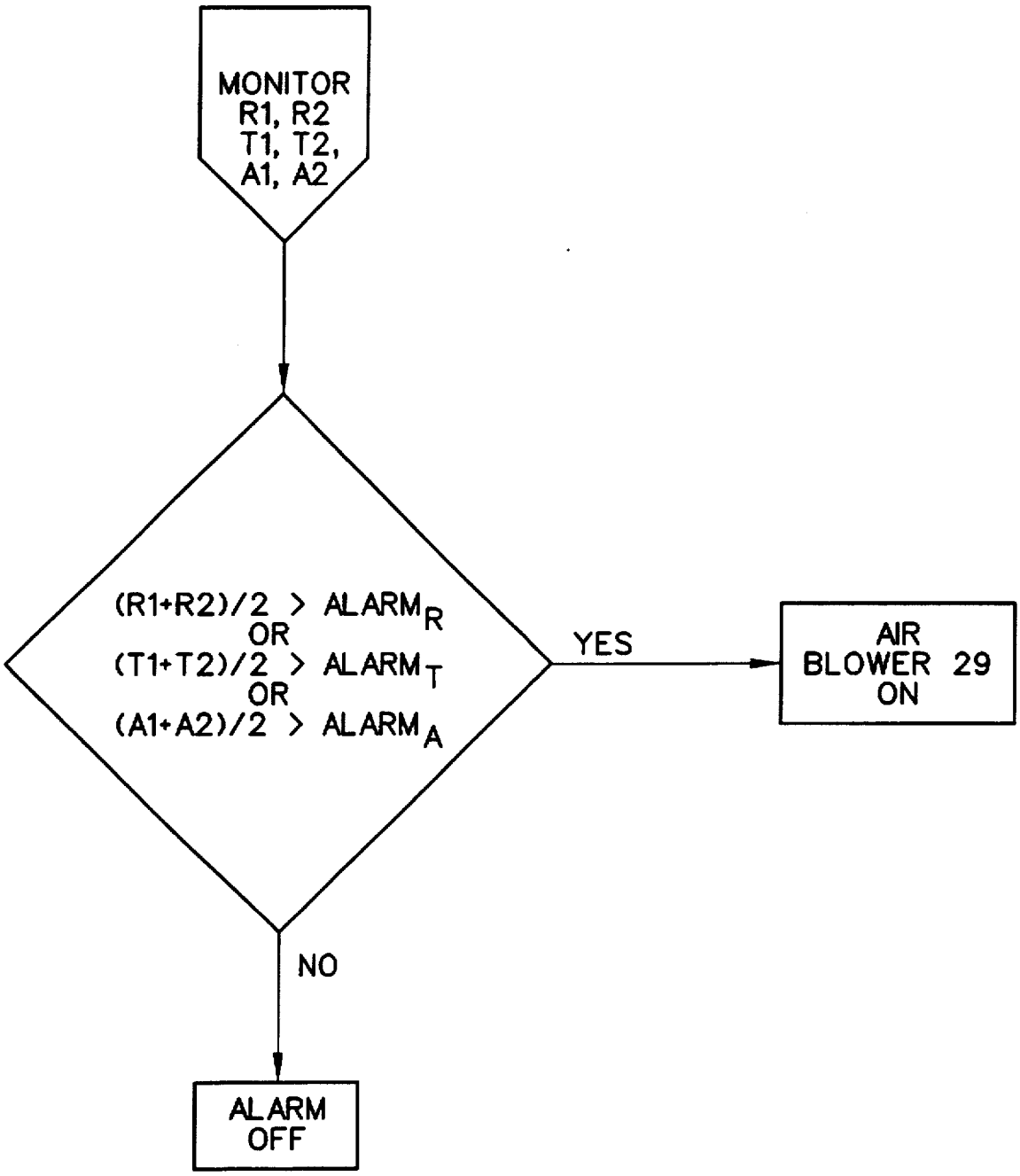

As shown in FIG. 2*e*, if the average of any one of the humidity levels $(R_1+R_2)/2$, the temperature levels ( $(T_1+T_2)/2$ or ethanol amine levels $(A_1+A_2)/2$ exceed their respective alarm levels (alarm$_R$, alarm$_T$, alarm$_A$), then the air blower 29 is activated to expel the atmosphere from the semi-enclosed area 100 of the housing 14, and all other valves 32–35 are closed, and the heater 48 is turned off.

Referring to FIG. 2*a*, if the average of the relative humidity signals $(R_1 30\ R_2)/2$ are below the set point$_R$ and there is no alarm$_{R,\ T,\ or\ A}$, the humidifier 18 will be turned on until the set point$_R$ is reached. Similarly, the cooling outlet valve 35 will be opened if there is no alarm$_{R,\ T,\ or\ A}$ and the average of the temperature signals $(T_1+T_2)/2$ are above the set point$_T$. If the average of the ethanol amine percentage signals $(A_1+A_2)/2$ is below the set point$_A$ and there is no alarm$_{R,\ T,\ or\ A}$, the heater is turned on until the set point$_A$ is reached.

In addition, the ethanol amine solution level (L) in the reservoir 20 can be checked via a level sensor 21. If the Level (L) is below a set point$_L$, and there is no alarm$_{R,\ T,\ or\ A}$, the supply valve 33 is turned on until the set point$_L$ is reached.

Moreover, a pH sensor 49 may be mounted within an ink pan 49 of the printing unit and connected to the control unit 37. It has been found that the tendency for an ink to dry prematurely is related to the pH level of the ink. Specifically, the lower the pH level of the ink, the lower the ethanol amine content of the ink, and the faster the ink will dry. The desired pH level can be set as a set poin$_{pH}$. If the pH reading is below the set point$_{pH}$, and there is no alarm$_{R,\ T,\ or\ A}$, then the heater 48 will be turned on. The heat from the heater 48 will cause additional ethanol amine to evaporate from the reservoir 20 into the semi-enclosed space 100. Once the ethanol amine content of the atmosphere begins to exceeds its saturation point, some ethanol amine will flow out of the atmosphere into the ink on the rollers 5–12, 46, 47, and in the ink pan 49 thereby increasing the ethanol amine content of the ink and the pH of the ink. The pH sensor 49 may be used as a substitute for the ethanol amine sensor 30.3, or in addition to the ethanol amine sensor 30.3.

In accordance with another embodiment of the present invention, the humidifier and humidity sensor can be eliminated, and the humidity in the semi-enclosed space 100 can be controlled by adding an appropriate amount of water to the ethanol amine solution in the reservoir 20. Since the water in the ethanol amine solution will, like the ethanol amine, evaporate as a function of the temperature and relative humidity of the atmosphere in the semi-enclosed space, by selecting the proper ratio of water to ethanol amine in the ethanol amine solution, the humidity in the semi-enclosed space will be maintained within the desired range. While this approach provides the advantage of eliminating the humidifier and humidity sensor, it requires that more attention be paid to the composition of the ethanol amine solution.

Figure 3:
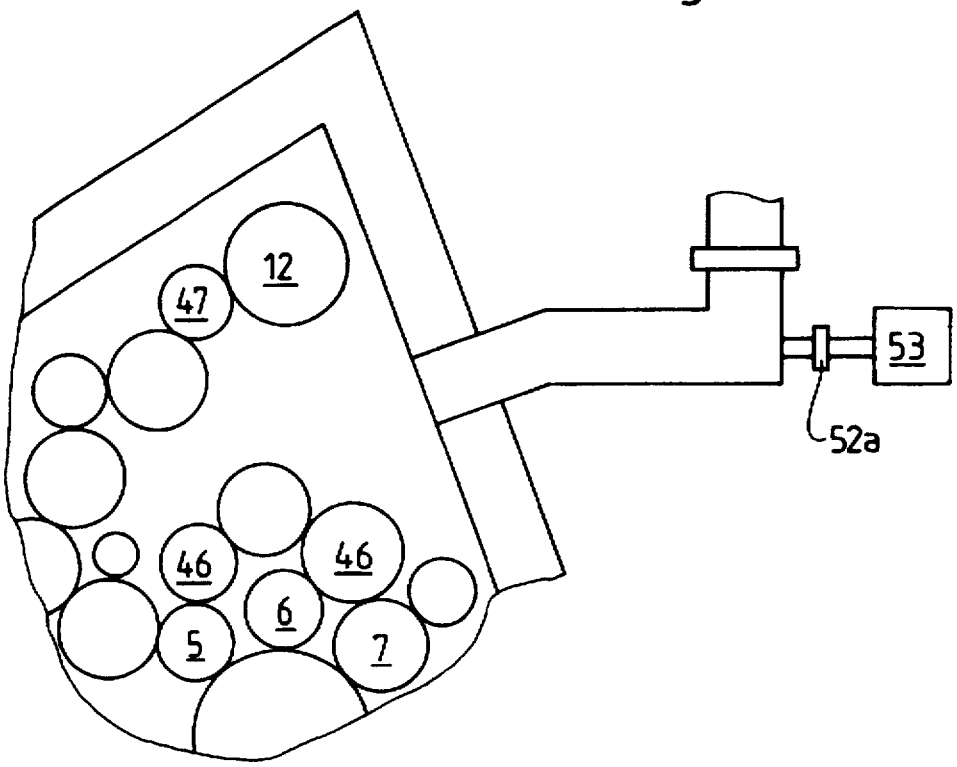
FIG. 3 shows an alternate embodiment of a chemical agent supply according to the present invention.

In accordance with an alternative embodiment of the present invention, and referring to FIG. 3, the reservoir 20 and heater 48 can be replaced with an ethanol amine gas inlet pipe 52 connected to a source of gaseous ethanol amine 53 through a valve 52*a*. In this embodiment, the ethanol amine content of the atmosphere can be increased by controlling the supply of ethanol amine gas into the semi-enclosed area 100.

Figure 4:
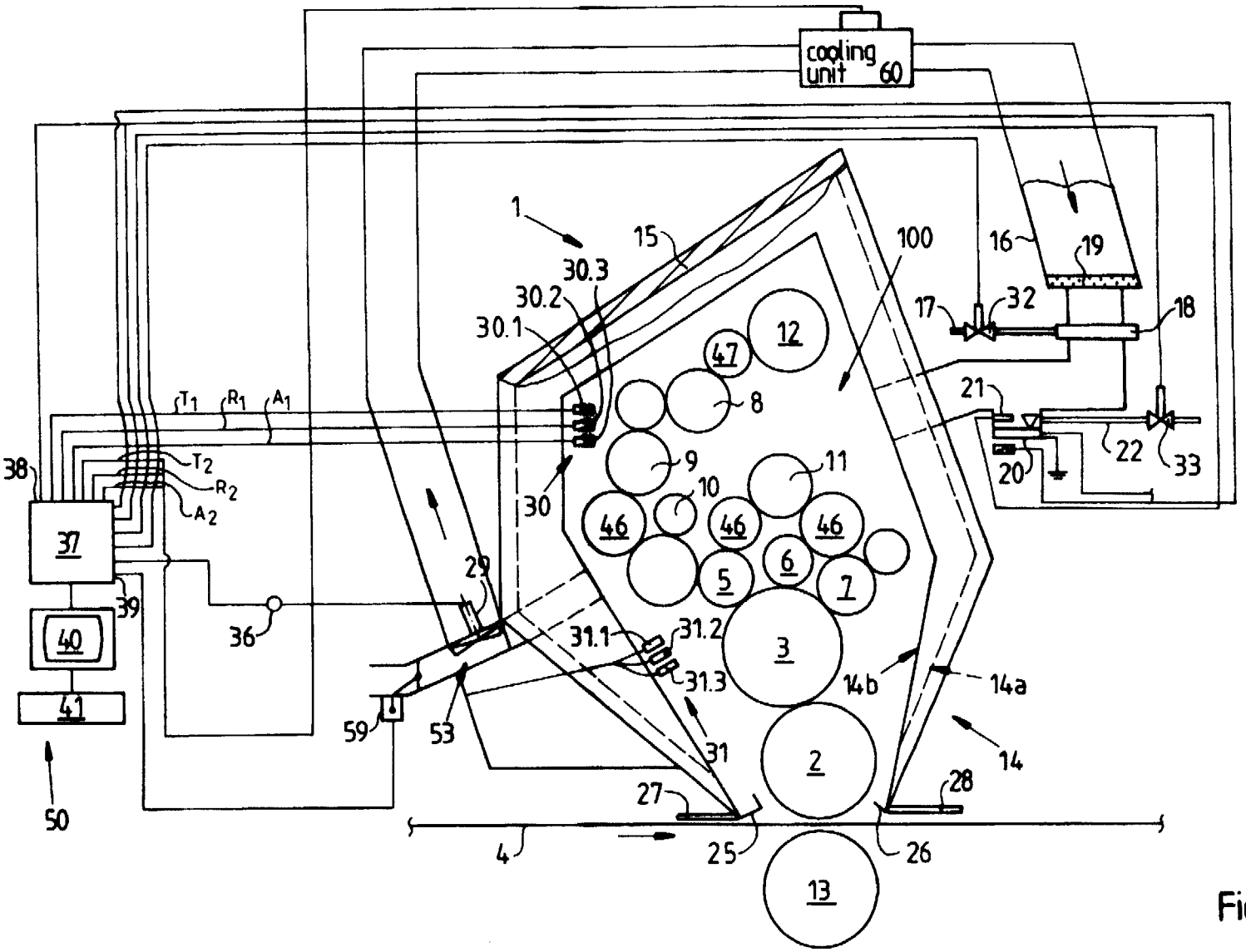
FIG. 4 shows an alternate embodiment of a cooling mechanism according to the present invention.

FIG. 4 shows another embodiment of the present invention. Similar components bear the identical reference numbers as FIG. 1. In accordance with this embodiment, a closed loop is formed between the air intake 16 and the air blower 29 and a cooling unit 60 is arranged in the closed loop between the air intake 16 and the air exhaust 53. The air blower 29 continuously circulates air out of the semi-enclosed area 100, through the cooling unit 60, the air filter 19, the humidifier 18, over the reservoir 20, and back into the semi-enclosed area 100. The humidifier 18 and heater 48 are activated as a function of the sensor outputs in the same manner as described above with regard to FIGS. 1–3. The cooling unit 60 replaces the cooling inlet 23 and cooling outlet 24 of FIG. 1 and is activated if the temperature in the semi-enclosed space 100 rises above the set point$_T$. If the average of any one of the humidity levels $(R_1+R_2)/2$, the temperature levels $((T_1+T_2)/2$ or ethanol amine levels $(A_1+A_2)/2$ exceed their respective alarm levels (alarm$_R$, alarm$_T$, alarm$_A$), then an exhaust valve 59 is opened to expel the atmosphere from the semi-enclosed area 100 of the housing 14, and the valves 32, 33, the heater 48, and the cooler 60 are disabled until all the levels have fallen below their alarm levels.

Figure 5:
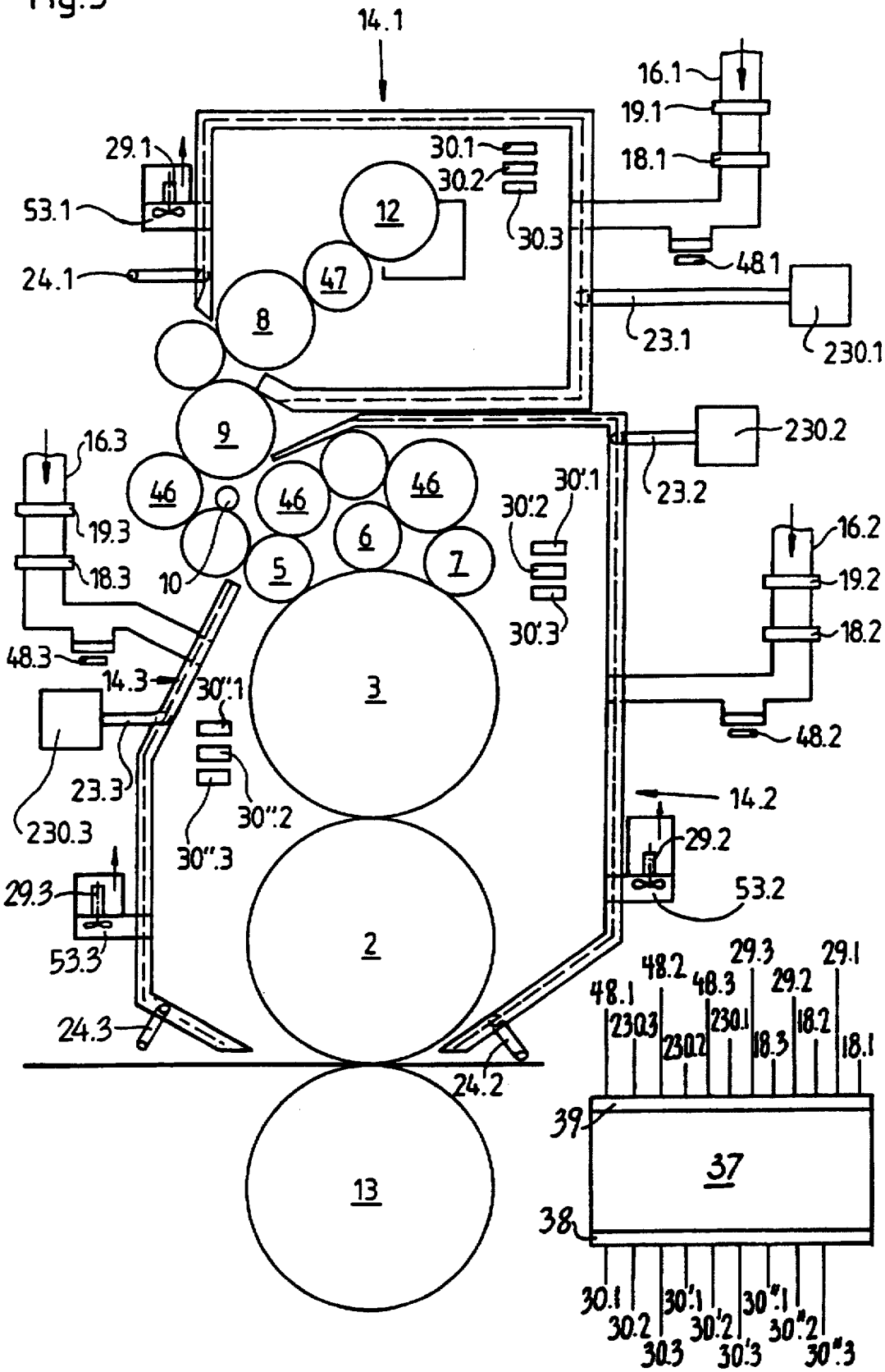
FIG. 5 shows a further embodiment of the present invention.

FIG. 5 shows an alternative embodiment of the present invention, with similar components bearing similar reference numerals to FIG. 1. A first sub-housing 14.1 having insulation 15.1 surrounds a fountain roller 12, a metering roller 47, and a distribution roller 8. A second sub-housing 14.2 having insulation 15.2 surrounds form rollers 5, 6, 7, vibrator rollers 46, and a back side of the print cylinder 3 and blanket cylinder 2. A third sub-housing 14.3 having insulation 15.3 surrounds a front side of the print cylinder 3 and blanket cylinder 2. Each sub-housing includes respective temperature (30.1, 30'.1, 30".1), humidity (30.2, 30'.2, 30".2), and chemical agent (30.3, 30'.3, 30".3) sensors for monitoring the atmosphere within the respective semi-enclosed areas 100. 1, 100.2, 100.2. In addition, each housing includes respective cooling inlets 23.1, 23.2, 23.3 and cooling outlets 24.1, 24.2, 24.3 for circulating cooling agent through the housing 14.1, 14.2, 14.3. In addition, each sub-housing includes a respective air intake 16.1, 16.2, 16.3 including air filters 19.1, 19.2, 19.3, humidifiers 18.1, 18.2, 18.3, reservoirs 20.1, 20.2, 20.3, and heaters 48.1, 48.2, 48.3 for controlling the humidity and chemical agent levels in the atmosphere in the semi-enclosed areas 100.1, 100.2, 100.3. Finally, each sub-housing includes blowing devices 29.1, 29.2, 29.3 and air exhausts 53.1, 53.2, 53.3 for exhausting the atmosphere from the semi-enclosed areas 100.1, 100.2, 100.3. The control unit 37 includes respective inputs connected to the sensors (30.1, 30.2, 30.3, 30'.1, 30'.2, 30'.3, 30".1, 30".2, 30".3) and respective outputs connected to the cooling inlet (23.1, 23.2, 23.3), the humidifiers (18.1, 18.2, 18.3), the air blowers (29.1, 29.2, 29.3), the heaters (48.1, 48.2, 48.3). In accordance with this embodiment, the atmosphere within each semi-enclosed area (100.1, 100.2, 100.3) can be independently controlled. It should be noted that the subdivisions shown in FIG. 5 are merely illustrative. For example, in certain applications, it may be advantageous to provide separate sub-housings for the print cylinder and blanket cylinder, or to enclose the entire inking unit in a single sub-housing. It may be desirable to subdivide the enclosed space across the printing rolls so that side to side or middle variations inherent in the printing unit may be adequately compensated.

Independent control of several semi-enclosed areas provides several advantages. For example, since the semi-enclosed areas are smaller, there will be less variation in temperature, humidity, and ethanol amine levels across each semi-enclosed space. Moreover, since certain components of the printing unit may become hotter than others during press operation, it may be advantageous to control the atmosphere surrounding different components in separate control systems. In addition, it may be advantageous to provide different set point and alarm levels for different sub-housings. For example, since the ink film on the ink carrying surfaces of the fountain roller 12, metering roller 47, and distribution roller 8 is thicker than the ink film on the distribution rollers 5, 6, 7, and print cylinder 3, evaporation of ethanol amine and water may be of less concern in sub-housing 14.1 than in sub-housings 14.2 and 14.3. Therefore, a press operator might wish to set the humidity and ethanol amine set points for sub-housing 14.1 lower than in sub-housings 14.2 and 14.3. In this manner, a different set point and alarm can be set for the front side of the print and blanket cylinders than for the fountain roller 12, metering roller 47 and distribution roller 8.

In accordance with further embodiments of the present invention, cooling units can be provided for circulating a cooling agent through one or more of the print cylinders, blanket cylinders, vibrator rollers, and fountain rollers of the printing unit as described in more detail in U.S. patent application Ser. No. 08/615,351 entitled Printing Unit for Water Based Inks, filed on even date herewith (attorney docket 1649/70, named inventor Roland T. Palmatier), the specification of which is hereby incorporated by reference. By controlling the circulation of cooling agent through one or more of the cylinders and rollers, additional control over the temperature of the ink carrying surfaces of the cylinders and rollers can be obtained.

What is claimed is:

1. A printing unit for a rotary printing press, comprising:

a print cylinder;

a water based ink;

an inking mechanism for applying the water based ink to the print cylinder, the water based ink including a substance;

a housing at least partially surrounding at least one of the inking mechanism and the print cylinder, an at least semi-enclosed space being formed between the housing and at least one of the inking mechanism and the print cylinder;

a chemical agent supply for adding a chemical agent to an atmosphere in the at least semi-enclosed space, the atmosphere with the chemical agent reducing a rate of evaporation of the substance from the water based ink.

2. The printing unit according to claim 1, wherein the substance in the water based ink is an organic amine compound.

3. The printing unit according to claim 2, wherein the chemical agent is an organic amine compound.

4. The printing unit according to claim 3, wherein the organic amine compound is ethanol amine.

5. The printing unit according to claim 2, wherein the organic amine compound is ethanol amine.

6. The printing unit according to claim 1, wherein the substance in the water based ink is ammonia.

7. The printing unit according to claim 6, wherein the chemical agent is ammonia.

8. The printing unit according to claim 1, wherein the substance in the water based ink is a pH increasing chemical.

9. The printing unit according to claim 2, wherein the chemical agent is a pH increasing chemical.

10. The printing unit according to claim 1, wherein:

the print cylinder comprises a printing plate, the printing plate comprising an aluminum oxide substrate with an image area coated with a photopolymer and a non-image area coated with a silicone polymer.

11. The printing unit of claim 1, wherein:

the chemical agent supply includes a reservoir for storing a solution containing the chemical agent, and a heater, the heater connected to the control unit.

12. The printing unit of claim 1, wherein:

the housing at least partially surrounds both the inking mechanism and the print cylinder.

13. The printing unit of claim 1, wherein:

the housing comprises a first housing at least partially surrounding the inking mechanism and a second housing at least partially surrounding the print cylinder, the at least semi-enclosed space comprising a first at least semi-enclosed space being formed between the first housing and the inking mechanism and a second at least semi-enclosed space being formed between the second housing and the print cylinder.

14. The printing unit of claim 13, wherein:

the chemical agent supply comprises a first chemical agent supply for adding a first chemical agent to an atmosphere in the first at least semi-enclosed space, the atmosphere with the first chemical agent reducing a rate of evaporation of the substance from the ink, and a second chemical agent supply for adding a second chemical agent to an atmosphere in the second at least semi-enclosed space, the atmosphere with the second chemical agent reducing a rate of evaporation of the substance from the ink.

15. A method for controlling an evaporation of a substance from an ink in a printing unit, the method comprising the steps of:

forming an at least semi-enclosed area around an inking unit and a print cylinder of a printing unit;

supplying a water based ink to the inking unit and the print cylinder; and supplying a chemical agent into an atmosphere within the semi-enclosed area so that the atmosphere within the semi-enclosed area reduces a rate of evaporation of the substance from the ink.

16. A printing unit for a rotary printing press, comprising a print cylinder;

an inking mechanism for applying an ink to the print cylinder, the ink including a substance;

a housing at least partially surrounding at least one of the inking mechanism and the print cylinder, an at least semi-enclosed space being formed between the housing and at least one of the inking mechanism and the print cylinder;

a chemical agent supply for adding a chemical agent to an atmosphere in the at least semi-enclosed space and for controlling the amount of the chemical agent in the atmosphere within the at least semi-enclosed space, the atmosphere with the chemical agent reducing a rate of evaporation of the substance from the ink;

a cooling mechanism for cooling the atmosphere within the at least semi-enclosed space;

a humidifier for controlling the humidity of the atmosphere within the at least semi-enclosed space; and a control unit coupled to the cooling mechanism, humidifier, and the chemical agent supply for selectively actuating the cooling mechanism to control the temperature, humidity, and amount of chemical agent in the atmosphere within the semi-enclosed space.

17. The printing unit according to claim 16, further comprising:

a temperature sensor mounted within the at least semi-enclosed space, and outputting a temperature signal to the control unit;

a humidity sensor mounted within the at least semi-enclosed space, and outputting a humidity signal to the control unit;

a chemical agent sensor mounted within the at least semi-enclosed space, and outputting a chemical agent level signal to the control unit; and wherein the control unit controls the cooling mechanism, the humidifier, and the chemical agent supply as a function of one or more of the temperature signal, the humidity signal, and the chemical agent signal.

18. The printing unit according to claim 17, wherein the ink is a water based ink.

19. The printing unit according to claim 18, wherein the substance in the water based ink is an amine compound.

20. The printing unit according to claim 19, wherein the chemical agent is an amine compound.

21. The printing unit according to claim 20, wherein the organic amine compound is ethanol amine.

22. The printing unit according to claim 19, wherein the organic amine compound is ethanol amine.

23. The printing unit according to claim 18, wherein the substance in the water based ink is ammonia.

24. The printing unit according to claim 23, wherein the chemical agent is ammonia.

25. The printing unit according to claim 18, wherein the substance in the water based ink is a pH increasing chemical.

26. The printing unit according to claim 18, wherein the chemical agent is a pH increasing chemical.

27. The printing unit according to claim 16, wherein the housing includes a hollow interior, and wherein the cooling mechanism includes a cooling inlet connected to the hollow interior of the housing, and a cooling outlet connected to the hollow interior of the housing, the cooling mechanism including means for circulating a cooling agent into the cooling inlet, through the hollow interior of the housing, and out of the cooling outlet.

28. The printing unit according to claim 16, further including an air exhaust extending from the semi-enclosed space through to the exterior of the housing, the air exhaust being connected to the control unit, the control unit activating the air exhaust as a function of one or more of the temperature signal, the humidity signal, and the chemical agent signal.

29. The printing unit according to claim 27, wherein the humidifier is mounted within the air intake.

30. The printing unit according to claim 27, wherein the chemical agent supply is mounted within the air intake.

31. The printing unit according to claim 16, wherein the chemical agent supply includes a reservoir for storing a solution containing the chemical agent, and a heater, the heater connected to the control unit.

32. The printing unit according to claim 16, wherein the chemical agent supply includes a chemical supply pipe extending from the semi-enclosed space to a chemical supply source, the chemical supply source supplying the chemical agent in a gaseous state through the chemical supply pipe.

33. The printing unit according to claim 27, wherein the chemical agent supply includes a chemical supply pipe extending from the air intake to a chemical supply source, the chemical supply source supplying the chemical agent in a gaseous state through the chemical supply pipe.

34. The printing unit of claim 16, wherein:

the housing at least partially surrounds both the inking mechanism and the print cylinder.

35. The printing unit of claim 16, wherein:

the housing comprises a first housing at least partially surrounding the inking mechanism and a second housing at least partially surrounding the print cylinder, the at least semi-enclosed space comprising a first at least semi-enclosed space being formed between the first housing and the inking mechanism and a second at least semi-enclosed space being formed between the second housing and the print cylinder.

36. The printing unit of claim 35, wherein:

the chemical agent supply comprises a first chemical agent supply for adding a first chemical agent to an atmosphere in the first at least semi-enclosed space, the atmosphere with the first chemical agent reducing a rate of evaporation of the substance from the ink, and a second chemical agent supply for adding a second chemical agent to an atmosphere in the second at least semi-enclosed space, the atmosphere with the second chemical agent reducing a rate of evaporation of the substance from the ink.

37. A printing unit for a rotary printing press, comprising a print cylinder;

an inking mechanism for applying an ink to the print cylinder, the ink including a substance;

a housing at least partially surrounding at least one of the inking mechanism and the print cylinder, an at least semi-enclosed space being formed between the housing and at least one of the inking mechanism and the print cylinder;

a chemical agent supply for adding a chemical agent to an atmosphere in the at least semi-enclosed space and for controlling the amount of the chemical agent in the atmosphere within the at least semi-enclosed space, the atmosphere with the chemical agent reducing a rate of evaporation of the substance from the ink;

a cooling mechanism for cooling the atmosphere within the at least semi-enclosed space, the cooling mechanism being connected between an air exhaust extending from the interior of the semi-enclosed space and an air intake extending into the interior of the semi-enclosed space;

a humidifier for controlling the humidity of the atmosphere within the at least semi-enclosed space; and a control unit coupled to the cooling mechanism, humidifier, and the chemical agent supply for selectively actuating the cooling mechanism to control the temperature, humidity, and amount of chemical agent in the atmosphere within the semi-enclosed space.

38. The printing unit of claim 37, wherein:

the housing at least partially surrounds both the inking mechanism and the print cylinder.

39. The printing unit of claim 37, wherein:

the housing comprises a first housing at least partially surrounding the inking mechanism and a second housing at least partially surrounding the print cylinder, the at least semi-enclosed space comprising a first at least semi-enclosed space being formed between the first housing and the inking mechanism and a second at least semi-enclosed space being formed between the second housing and the print cylinder.

40. The printing unit of claim 39, wherein:

the chemical agent supply comprises a first chemical agent supply for adding a first chemical agent to an atmosphere in the first at least semi-enclosed space, the atmosphere with the first chemical agent reducing a rate of evaporation of the substance from the ink, and a second chemical agent supply for adding a second chemical agent to an atmosphere in the second at least semi-enclosed space, the atmosphere with the second chemical agent reducing a rate of evaporation of the substance from the ink.

41. A method for controlling an evaporation of a substance from an ink in a printing unit, the method comprising the steps of:

forming an at least semi-enclosed area around an inking unit and a print cylinder of a printing unit;

supplying a chemical agent into an atmosphere within the semi-enclosed area so that the atmosphere within the semi-enclosed area reduces a rate of evaporation of the substance from the ink, wherein the chemical agent is supplied into the semi-enclosed area as a function of one or more of the temperature level, the relative humidity level, and the chemical supply level to reduce the rate of evaporation of the substance from the ink;

monitoring the atmosphere within the semi-enclosed area to obtain a temperature level;

monitoring the atmosphere within the semi-enclosed area to obtain a relative humidity level;

monitoring the atmosphere within the semi-enclosed area to obtain a chemical agent level;

controlling a temperature of the atmosphere within the semi-enclosed area as a function of one or more of the temperature level, the relative humidity level, and the chemical supply level; and controlling a relative humidity of the atmosphere within the semi-enclosed area as a function of one or more of the temperature level, the relative humidity level, and the chemical supply level.

* * * * *